US006431386B1

(12) United States Patent
Hofman et al.

(10) Patent No.: US 6,431,386 B1
(45) Date of Patent: Aug. 13, 2002

(54) CORNER CADDY BUCKET

(75) Inventors: James A. Hofman, Hockessin; Paul H. Winter, Newark, both of DE (US); Paul Wojtowicz, Downingtown, PA (US)

(73) Assignee: Zenith Products Corp., New Castle, DE (US)

( * ) Notice: Subject to any disclaimer, the term of this patent is extended or adjusted under 35 U.S.C. 154(b) by 0 days.

(21) Appl. No.: 09/459,247

(22) Filed: Dec. 10, 1999

Related U.S. Application Data

(60) Provisional application No. 60/111,985, filed on Dec. 12, 1998.

(51) Int. Cl.[7] ..... B65D 43/00

(52) U.S. Cl. ..... 220/481; 220/840; 248/220.1

(58) Field of Search ..... 220/481, 480, 220/476, 840; 248/205.1, 220.1

(56) References Cited

U.S. PATENT DOCUMENTS 672,417 A * 4/1901 Field ..... 220/481
2,743,075 A * 4/1956 Johnson ..... 220/481 X
5,577,628 A * 11/1996 O'Neil et al. ..... 220/840

* cited by examiner

*Primary Examiner*—Steven Pollard
(74) *Attorney, Agent, or Firm*—Edgar A. Zarins; Lloyd D. Doigan

(57) ABSTRACT

A corner bucket for storing items within a bathing unit. The caddy includes a substantially L-shaped bucket to fit in a corner and a bracket for hanging the bucket. The bracket includes bracket portions for each of the walls which may be secured using fasteners or suction cups. The bracket includes hooks which are received by corresponding openings in the bucket such that the bucket detachably hangs from the bracket.

10 Claims, 2 Drawing Sheets

CORNER CADDY BUCKET

RELATED APPLICATIONS

This application claims priority from U.S. Provisional Application No. 60/111,985 filed on Dec. 12, 1998.

BACKGROUND OF THE INVENTION

I. Field of the Invention

This invention relates to caddy buckets for retaining bathing items in a bathing unit and, in particular, to a corner caddy bucket which is readily and securely mounted within a corner of the bathing unit.

II. Description of the Prior Art

Consumers have demanded conveniences throughout the home. Such conveniences even extend to such aspects as the shower or bath where users require convenient storage for easy access to bathing items. The prior known storage units have included corner caddies which may have a plurality of shelves supported on a pole extending vertically. Bucket caddies may be mounted to the wall of the bathing unit to provide deeper wells for storage bathing items. However, the attachment of such storage devices can pose a problem particularly on irregular surfaces such as tiled walls. Suction cups require a smooth clean surface to maintain engagement. Any permanent securement such as threaded fasteners prevent the storage bucket from being conveniently removed for cleaning.

SUMMARY OF THE PRESENT INVENTION

The present invention overcomes the disadvantages of the prior known bathing storage units by providing a corner caddy bucket which is readily and securely attached to the walls of the shower or bath.

The corner caddy bucket of the present invention includes a deep well bucket having a substantially L configuration to fit into a corner of the bathing unit. The bucket is configured to hold items such as shampoo bottles. A hanging bracket is mountable to the corner walls of the bathing unit such that the bucket may be detachably secured to the bracket. The bracket preferably has an integral construction with a living hinge dividing bracket portions securable to the walls of the corner. The bracket portions include apertures for receiving fasteners to secure the bracket to the walls. Alternatively, suction cups may be attached to the apertures for securing the bracket to the wall. Sufficient apertures are provided such that the suction cups may be arranged to avoid the grout lines of tile which would disturb the securement of the bracket.

The bucket includes openings adapted to receive hooks extending from the face of the bracket. Once the bracket is secured to the corner walls, the bucket is positioned on the bracket so as to hang from the bracket. In this manner, the bucket may be conveniently removed for cleaning.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
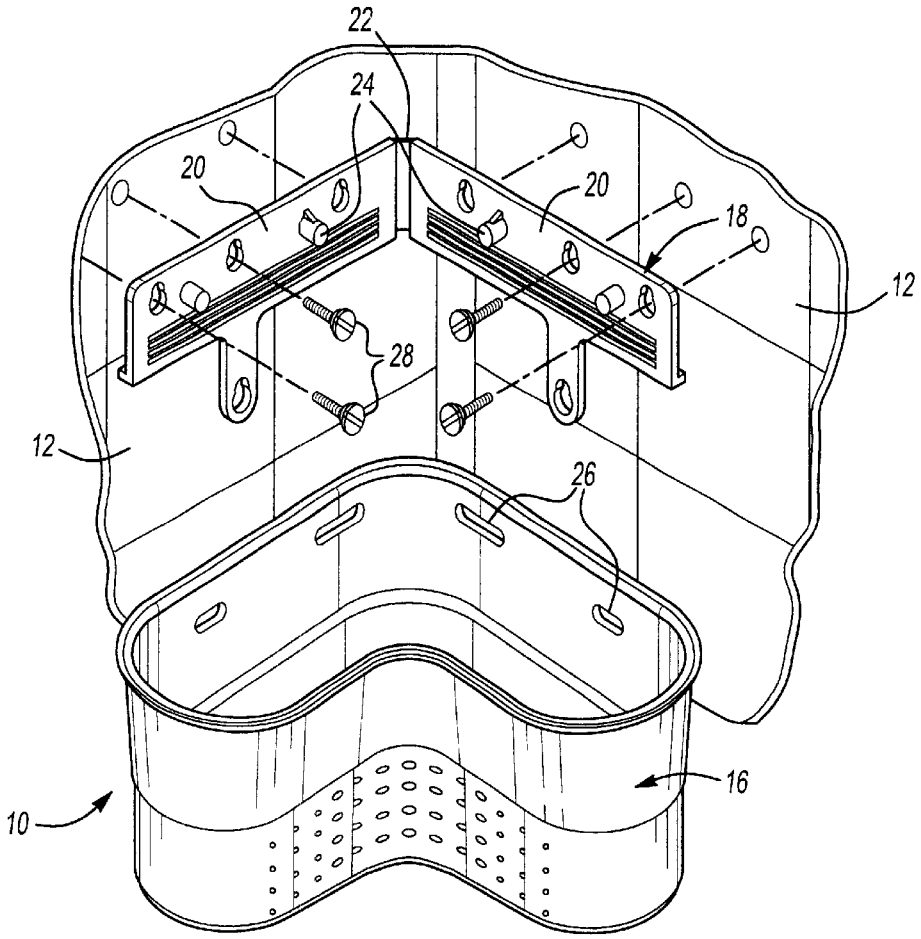
FIG. 1 is an exploded view of a corner caddy bucket embodying the present invention.

Referring to the drawing, there is shown a corner caddy bucket 10 embodying the present invention and adapted to be secured to the corner walls 12 of a bathing unit 14. The caddy 10 includes a bucket 16 having a substantially L-shaped top plan configuration and is sufficiently deep to retain shampoo bottles and the like. The bucket 16 is secured to the walls 12 by a bracket 18 which has a pair of bracket portions 20 preferably connected by a living hinge 22. The bracket 18 includes hooks 24 received within openings 26 of the bucket 16 to detachably mount the bucket 16 to the walls 12. The bracket 18 may be secured to the walls 12 using fasteners 28 or suction cups 30.

Figure 2:
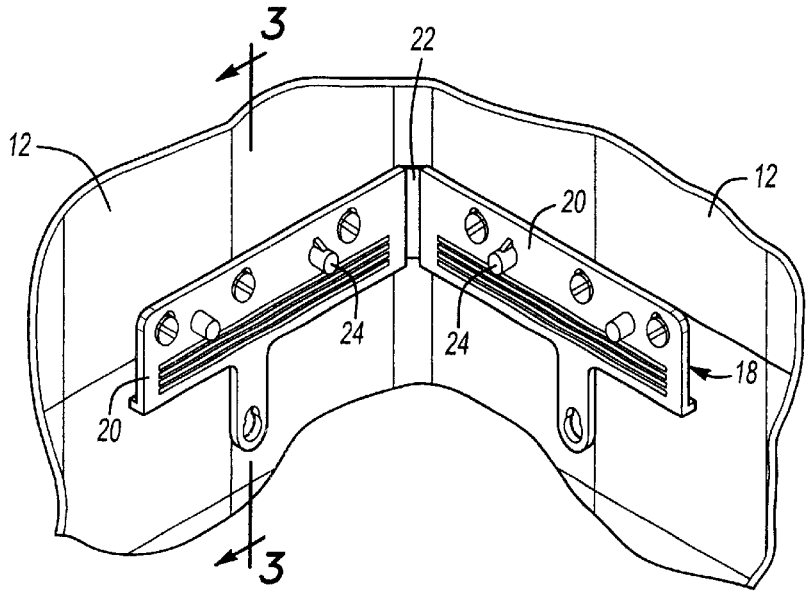
FIG. 2 is a perspective view of the bracket secured to the wall of the bathing unit.
Figure 4:
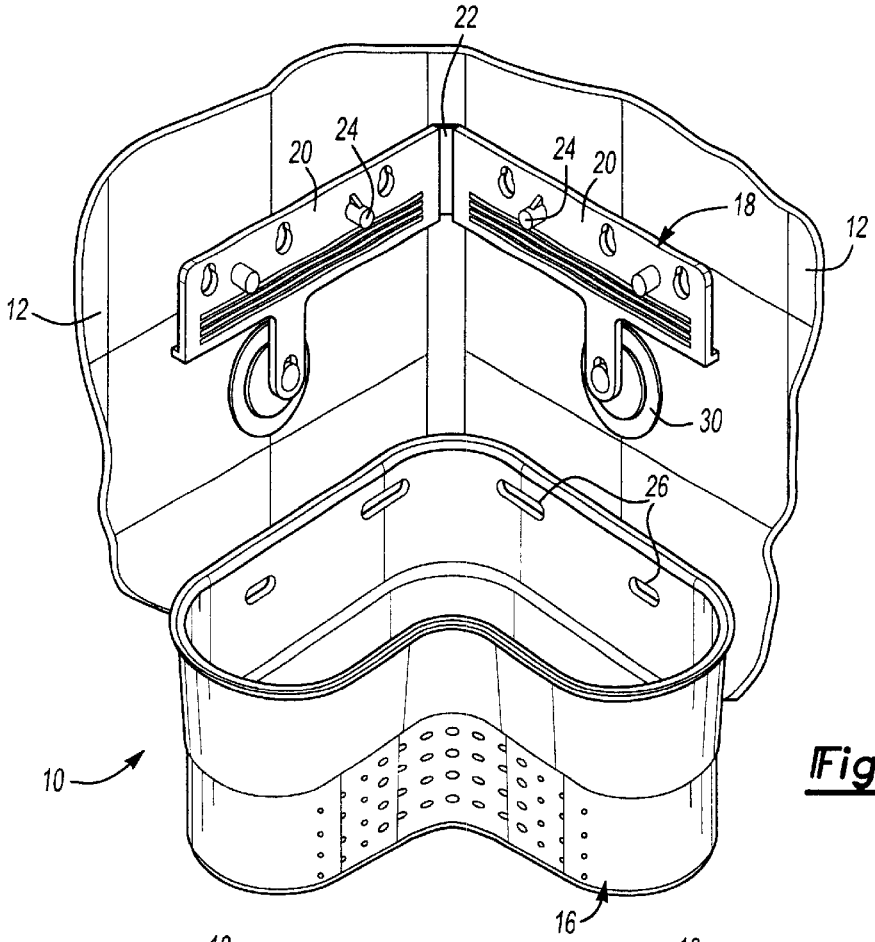
FIG. 4 is a perspective view of the corner caddy bucket with the bracket mounted to the walls using suction cups.
Figure 3:
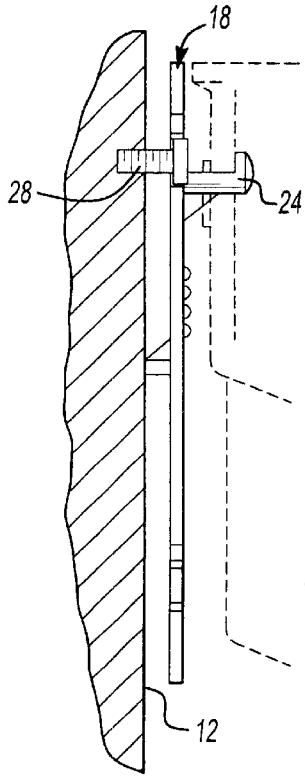
FIG. 3 is an enlarged view of the bracket mounted to the wall using threaded fasteners.
Figure 5:
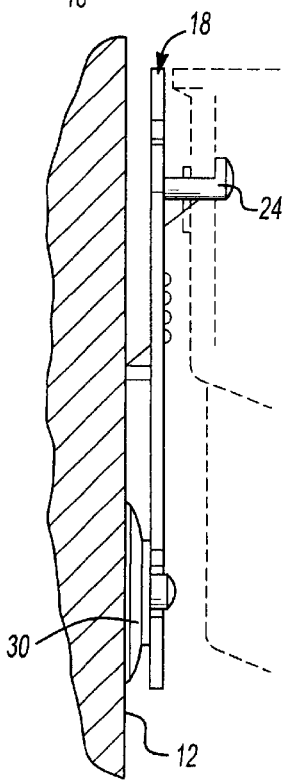
FIG. 5 is an enlarged view of the bracket mounted to the wall using suction cups.

Referring to FIGS. 1 and 2, the bracket 18 is integrally formed with a first bracket portion 32 connected to a second bracket portion 34 by the living hinge 22. The hinge 22 allows the bracket 18 to be packaged flat. Each of the bracket portions 32,24 include a row of apertures 36 adapted to receive fasteners 28 for securing the bracket 18 to the wall 12. Preferably, the apertures 36 have a keyhole configuration allowing securement of the fasteners 28 and subsequent mounting and removal of the bracket 18.

To provide alternative means of mounting the accessory 10, the bracket portions 32,34 each include a downwardly depending tab 38 having a single aperture 40. The aperture 40 is designed to detachably receive the suction cup 30. Thus, as an alternative to the permanent attachment provided by the fasteners 28, the suction cups 30 can be used to detachably mount the bucket 16 to the wall 12. However, instead of requiring separate brackets, the single bracket 18 can be used for either attachment.

Protruding from the face of the bracket portions 32,34 are a plurality of posts 24 molded into the bracket 18. The posts 24 are removably received through slots or apertures 26 formed in the caddy bucket 16. This allows the bucket 16 to be readily removed along with its contents for transport, cleaning or emptying.

The caddy bucket 16 has a substantially L-shaped configuration in order to conform to the bracket 18 and the corner walls 12. The bucket 16 is integrally molded and includes inner walls 42 disposed at right angles to each other. The apertures 26 are formed in the inner walls 42 corresponding to the spacing of the posts 24. In a preferred embodiment, the bucket 16 includes a perforated section 44 to allow drainage.

The foregoing detailed description has been given for clearness of understanding only and no unnecessary limitations should be understood therefrom as some modifications will be obvious to those skilled in the art.

What is claimed is:

1. A caddy adapted to be mounted to the corner walls of a bathing area, said caddy comprising:

an integral mounting bracket having first and second portions;

means for securing said first and second portions of said mounting bracket to the opposing corner walls, said first portion secured to a first corner wall and said second portion secured to a second corner wall; and a caddy bucket detachably secured to said first and second portions of said mounting bracket.

2. The caddy as defined in claim 1 wherein said caddy bucket has a substantially L-shaped configuration adapted to be mounted within the corner walls, said caddy bucket having a first wall portion detachably mounted to said first bracket portion and a second wall portion detachably mounted to said second bracket portion.

3. The caddy as defined in claim 2 wherein said first bracket portion is integrally connected to said second bracket portion by a living hinge.

4. The caddy as defined in claim 3 wherein said means for securing said mounting bracket includes one of a plurality of suction cups and a plurality of threaded fasteners.

5. The caddy as defined in claim 4 wherein said securing means engages each of said first and second bracket portions.

6. The caddy as defined in claim 3 wherein said first and second bracket portions include at least one post, said caddy bucket having a corresponding number of apertures removably receiving said posts to mount said caddy bucket to the bracket.

7. The caddy as defined in claim 6 wherein said caddy bucket includes a perforated portion.

8. A caddy adapted to be mounted to first and second corner walls of a bathing area, said caddy comprising:

an integral mounting bracket having first and second portions joined at a corner, said first bracket portion fixedly mounted to the first corner wall and said second bracket portion fixedly mounted to the second corner wall; and a caddy bucket detachably secured to said mounting bracket, said caddy bucket having a first wall portion detachably secured to said first bracket portion and a second wall portion detachably secured to said second bracket portion.

9. The caddy as defined in claim 8 wherein said first bracket portion is integrally connected to said second bracket portion by a living hinge.

10. The caddy as defined in claim 9 wherein said first and second bracket portions include at least one post, said caddy bucket having a corresponding number of apertures removably receiving said posts to mount said caddy bucket to the bracket.

* * * * *